US011130149B2

(12) United States Patent
Lu

(10) Patent No.: US 11,130,149 B2
(45) Date of Patent: Sep. 28, 2021

(54) FAST HOT MELT ADHESIVE GUN

(71) Applicant: Ningbo Yaosheng Tools Industrial Co. LTD, Ningbo (CN)

(72) Inventor: Hongbiao Lu, Ningbo (CN)

(73) Assignee: NINGBO YAOSHENG TOOLS INDUSTRIAL CO. LTD, Ningbo (CN)

( * ) Notice: Subject to any disclaimer, the term of this patent is extended or adjusted under 35 U.S.C. 154(b) by 0 days.

(21) Appl. No.: 17/074,649

(22) Filed: Oct. 20, 2020

(65) Prior Publication Data

US 2021/0268538 A1 Sep. 2, 2021

(30) Foreign Application Priority Data

Aug. 22, 2019 (CN) ..... 201910777251.3

(51) Int. Cl.
*B05C 17/005* (2006.01)

(52) U.S. Cl.
CPC .... *B05C 17/00546* (2013.01); *B05C 17/0053* (2013.01)

(58) Field of Classification Search
CPC ..... B05C 17/0053; B05C 17/00546; B05C 17/00526; B05C 17/00523
USPC ..... 222/146.2, 146.5
See application file for complete search history.

(56) References Cited

U.S. PATENT DOCUMENTS 3,743,142 A * 7/1973 Elliott ..... B29C 66/861 222/146.5
5,236,269 A * 8/1993 Handy ..... B05C 17/0053 219/227
5,462,206 A * 10/1995 Kwasie ..... B05C 17/0053 222/146.5
5,688,421 A * 11/1997 Walton ..... B05C 17/00526 219/230
6,065,888 A * 5/2000 Maayeh ..... B05C 17/0053 222/146.2
6,105,824 A * 8/2000 Singleton ..... B05C 17/0053 219/221
6,223,950 B1 * 5/2001 Lasko ..... B05C 17/0053 219/426
6,457,889 B1 * 10/2002 Lin ..... B05C 17/0053 126/401
6,502,766 B1 * 1/2003 Streutker ..... B05B 9/0861 239/332

(Continued)

*Primary Examiner* — Patrick M. Buechner
*Assistant Examiner* — Michael J. Melaragno
(74) *Attorney, Agent, or Firm* — Bayramoglu Law Offices LLC

(57) ABSTRACT

A fast hot melt adhesive gun includes an adhesive gun housing, wherein an end part of one end of the adhesive gun housing is provided with an adhesive inlet, a heating cavity used for heating an adhesive rod is formed in the adhesive gun housing, an inner wall of the adhesive gun housing is fixedly connected with a chute for the adhesive rod to slide, the heating cavity comprises a funnel-shaped heating head, a rear end of the funnel-shaped heating head is in communication with a connecting pipe, an outside of the funnel-shaped heating head is wrapped with a PTC heating layer, an inner diameter of the funnel-shaped heating head is gradually reduced from a first end at the connecting pipe to a second end at the funnel-shaped heating head, a front end of the funnel-shaped heating head is in communication with a copper sleeve.

8 Claims, 4 Drawing Sheets

(56) References Cited

U.S. PATENT DOCUMENTS

| | | | | |
|---|---|---|---|---|
| 7,520,408 | B1 * | 4/2009 | Smith | B05C 17/0053 219/200 |
| 8,319,654 | B2 * | 11/2012 | Field | B08B 3/08 340/815.4 |
| 9,586,229 | B1 * | 3/2017 | Lee | B05C 17/0053 |
| 10,413,931 | B1 * | 9/2019 | Drachenberg | B05C 17/0053 |
| 10,857,564 | B1 * | 12/2020 | Horian | B05C 17/002 |
| 2003/0127465 | A1 * | 7/2003 | MacLean | B05B 12/00 222/146.5 |
| 2003/0150875 | A1 * | 8/2003 | Belanger | B05C 17/00526 222/146.5 |
| 2003/0205566 | A1 * | 11/2003 | Evanyk | B05C 17/0053 219/221 |
| 2004/0108335 | A1 * | 6/2004 | Girouard | B44D 3/22 222/146.5 |
| 2006/0081650 | A1 * | 4/2006 | Axinte | B05C 17/00526 222/146.2 |
| 2006/0191957 | A1 * | 8/2006 | Axinte | B05C 17/00526 222/146.5 |
| 2015/0209820 | A1 * | 7/2015 | Ono | B05C 17/00546 222/80 |
| 2017/0080449 | A1 * | 3/2017 | Lee | B05B 15/63 |
| 2017/0128977 | A1 * | 5/2017 | Hsu | B05C 17/00546 |
| 2019/0283073 | A1 * | 9/2019 | Belanger | B05C 5/0225 |
| 2020/0122188 | A1 * | 4/2020 | Tumey | B05C 17/00503 |

* cited by examiner

FAST HOT MELT ADHESIVE GUN

CROSS REFERENCE TO THE RELATED APPLICATIONS

This application is based upon and claims priority to Chinese Patent Application No. 201910777251.3, filed on Aug. 22, 2019, the entire contents of which are incorporated herein by reference.

TECHNICAL FIELD

The present invention relates to the technical field of hot melt adhesive guns, in particular to a fast hot melt adhesive gun.

BACKGROUND

Hot melt adhesive guns are widely used for bonding articles in the fields of decoration, food, packaging, electronics, etc. By heating a hot melt adhesive rod in an adhesive gun, the hot melt adhesive rod melts and flows out, and the melted adhesive is applied to a bonding part to achieve bonding.

The existing hot melt adhesive guns require a long heating time, which affects the fast adhesive output of the hot melt adhesive guns, so the existing hot melt adhesive guns are inconvenient to use, and need to be preheated for a period of time in advance, which is generally 2-3 minutes. Therefore, it is necessary to improve the existing hot melt adhesive guns to shorten the preheating time and make the guns more convenient and faster for users to use.

SUMMARY

The main purpose of the present invention is to provide a fast hot melt adhesive gun to solve the technical problem that the hot melt adhesive guns in the prior art require a long preheating time, which affects the fast adhesive output of the hot melt adhesive guns.

To achieve the above purpose, the present invention adopts the following technical solution: a fast hot melt adhesive gun, comprising an adhesive gun housing, wherein the end part of one end of the adhesive gun housing is provided with an adhesive inlet, a heating cavity used for heating an adhesive rod is formed in the adhesive gun housing, the inner wall of the adhesive gun housing is fixedly connected with a chute for the adhesive rod to slide, the heating cavity comprises a funnel-shaped heating head, the rear end of the heating head is in communication with a connecting pipe, the outside of the heating head is wrapped with a PTC heating layer, the inner diameter of the heating head is gradually reduced from the end at the connecting pipe to the end at the heating head, the front end of the heating head is in communication with a copper sleeve, the copper sleeve is provided with an adhesive outlet through which melted adhesive rod flows out, and the center line of the adhesive rod is always aligned with the center line of the heating head.

Further, the inner wall of the adhesive gun housing is rotationally connected with a trigger, part of the trigger extends to the outside of the adhesive gun housing, the trigger is located on the inner side of the adhesive gun housing and is fixedly connected with a first connecting piece, and the first connecting piece is hinged with a second connecting piece; the inner wall of the adhesive gun is slidably connected with a sliding block, the second connecting piece is hinged on the sliding block, and the first connecting piece and second connecting piece have openings for the adhesive rod to pass through. When the trigger is pulled by a user, the trigger is rotated together with the first connecting piece, and the first connecting piece moves together with the second connecting piece, thus the sliding block is driven to move together with the adhesive rod, making the adhesive rod fed into the heating head to be melted again, which is convenient for adhesive to flow out.

Further, a PCB assembly is arranged in the adhesive gun housing, the PCB assembly is connected with a light button, and an indicator light is arranged on the surface of the adhesive gun housing. The PCB assembly is a central control circuit board, and the light button is electrically connected with the indicator light of the adhesive gun housing for the convenience of indication.

Further, a battery jar used for holding dry batteries is formed in the bottom of the adhesive gun housing. The present invention can be powered by dry batteries.

Further, the adhesive rod is sheathed with an anti-slide member at the position against the adhesive inlet to prevent the adhesive rod from shifting. In order to prevent the adhesive rod from shifting, the anti-slide member is provided.

Further, the adhesive rod is sheathed with a spring at the position against the joint of the heating cavity and the connecting pipe.

Further, the surface of the adhesive gun housing has a plurality of viewing windows used for observing the remaining amount of the adhesive rod, and the number of the viewing windows is two. The viewing windows are used for observing the remaining amount of the adhesive rod in real time, and a new adhesive rod can be added in time when the remaining amount is insufficient.

Further, the surface of the adhesive gun housing has a jack used for charging. The present invention can also be powered by rechargeable batteries, and the jack can provide a charging space for the rechargeable batteries.

The principle of the present invention is as follows: when the adhesive gun is used, an adhesive rod is first inserted into the adhesive gun along the adhesive inlet, and passes through the connecting pipe to the heating head and the copper sleeve at the same time. Then power is switched on to make the PTC heating layer start to work and transfer heat to the heating head. As the heating head is set in a funnel shape, the heat radiation distance from the PTC heating layer to the adhesive rod is reduced along the reducing direction of the inner diameter of the funnel, making the heat radiation distance the smallest at the front end of the heating head, i.e., at the part of the funnel with the smallest inner diameter; thus the heating time is shorter (which is reduced from the original 2-3 minutes to 15 seconds), and the heating is more uniform. As the heating cavity has a good thermal conductivity, the adhesive rod in the heating cavity is quickly melted by the heating head, and heat is transferred to the copper sleeve; the copper sleeve also has a good thermal conductivity, so adhesive can flow out from the adhesive outlet in the copper sleeve, and the adhesive outlet in the copper sleeve only need to be aimed at a position that need to be bonded.

The present invention has the advantages that: an existing heating cavity is square and fitted with heating plates on the surface, and a circular opening for an adhesive rod to pass through is formed in the center; when the heating plate works, the distances from different positions on the heating cavity to the center of the adhesive rod are different, so the heating is nonuniform, and the heating time is relatively long. In the present invention, the shape of the heating cavity is changed into a funnel shape, the cross section of the funnel shape is circular, and the distances from different positions on the heating cavity to the center of the adhesive rod are the same, so the heat radiation distances are also the same; therefore, the heating is uniform, and the heating time is relatively short.

Figure 1:
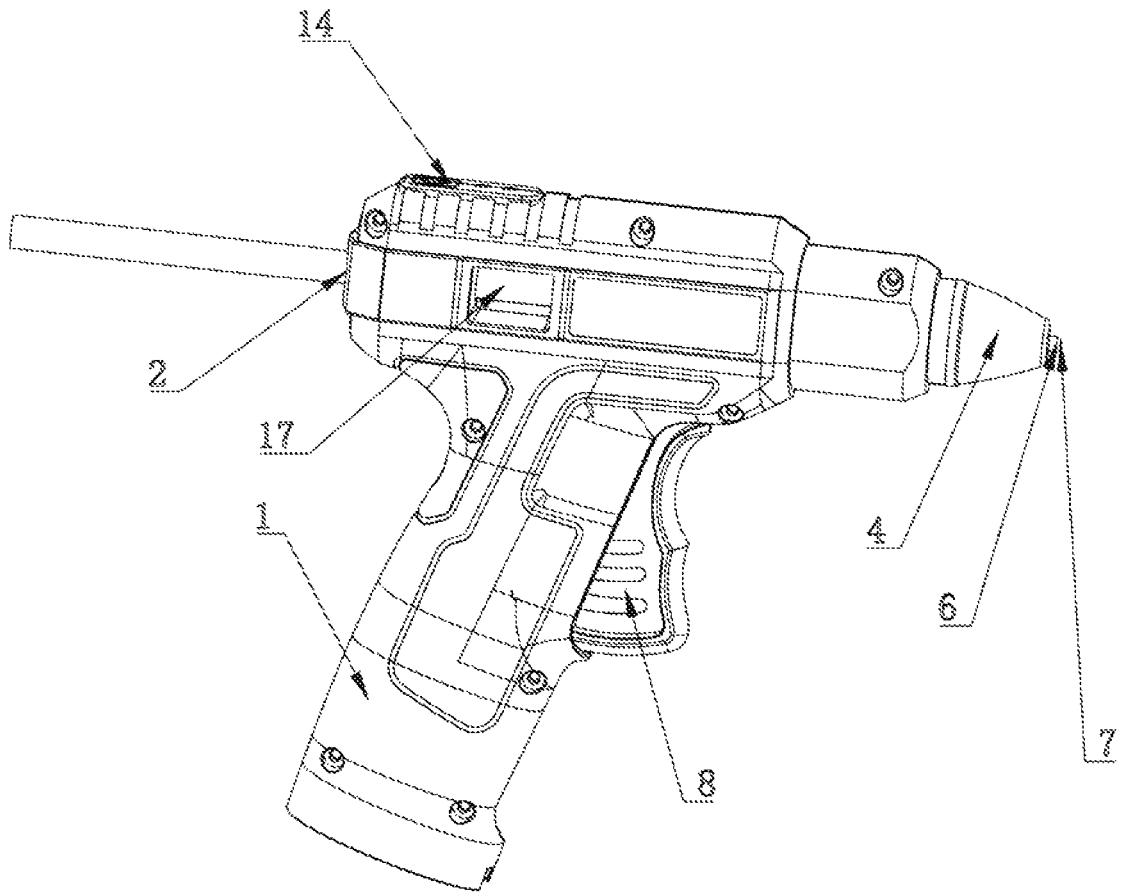
FIG. 1 is a schematic diagram of a fast hot melt adhesive gun of the present invention.

Reference signs: adhesive gun housing 1, adhesive inlet 2, chute 3, heating head 4, connecting pipe 5, copper sleeve 6, adhesive outlet 7, trigger 8, first connecting piece 9, second connecting piece 10, sliding block 11, sleeve 12, PCB assembly 13, light button 14, anti-slide member 15, spring 16, viewing window 17, and jack 18.

DETAILED DESCRIPTION OF THE EMBODIMENTS

The following description is used to disclose the present invention so as to enable those skilled in the art to realize the present invention. The preferred embodiment in the following description is only an example, and those skilled in the art can think of other obvious variations.

Figure 2:
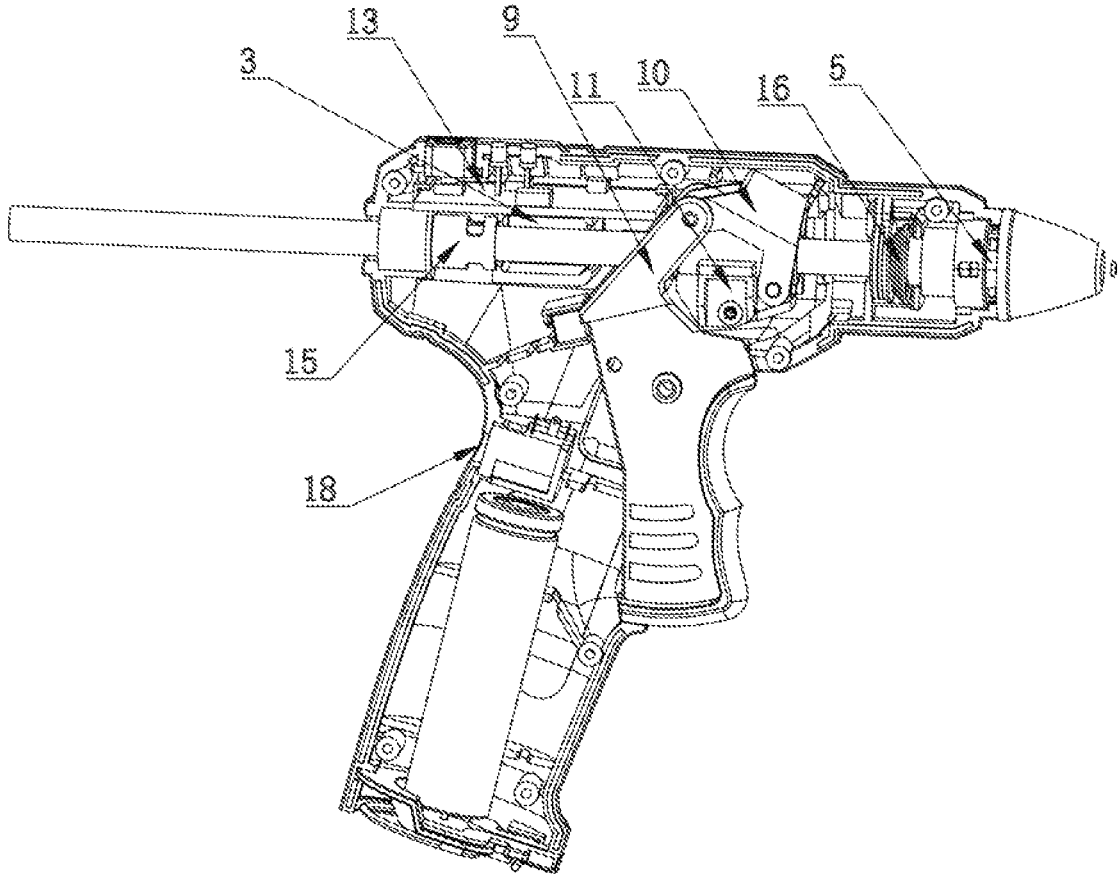
FIG. 2 is an internal structural schematic diagram of a fast hot melt adhesive gun of the present invention.
Figure 3:
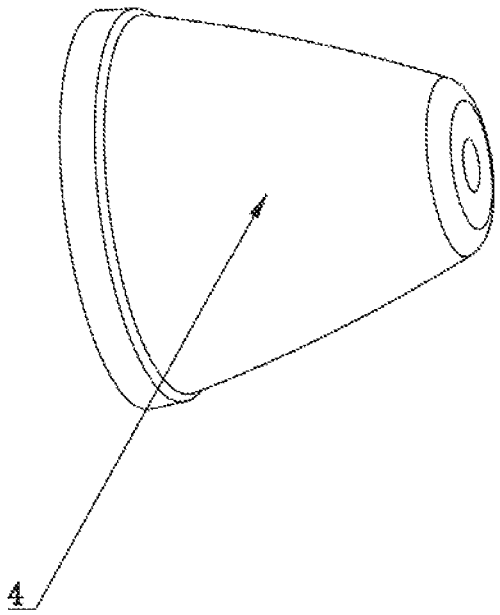
FIG. 3 is a schematic diagram of a heating head in the present invention.
Figure 4:
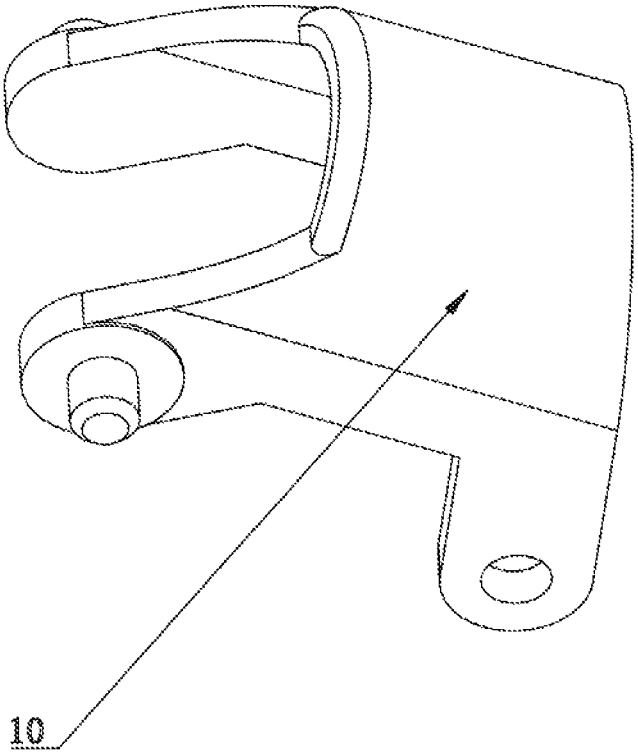
FIG. 4 is a schematic diagram of a second connecting piece in the present invention.
Figure 5:
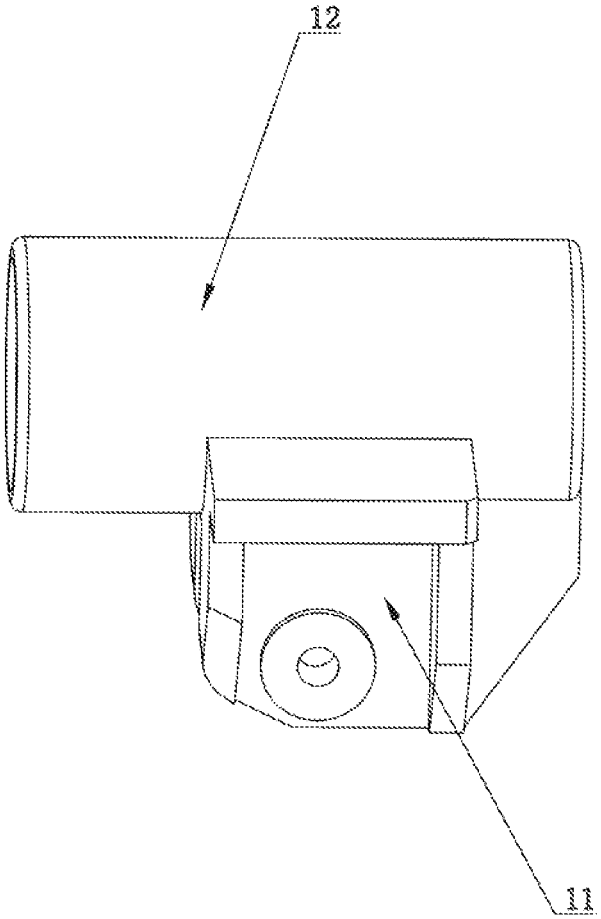
FIG. 5 is a schematic diagram of a sliding block and a sleeve in the present invention.

Embodiment 1 of the present invention 1 is shown in FIGS. 1-5: a fast hot melt adhesive gun, comprising an adhesive gun housing 1, wherein the end part of one end of the adhesive gun housing 1 is provided with an adhesive inlet 2, a heating cavity used for heating an adhesive rod is formed in the adhesive gun housing 1, the inner wall of the adhesive gun housing 1 is fixedly connected with a chute 3 for the adhesive rod to slide, the heating cavity comprises a funnel-shaped heating head 4, the rear end of the heating head 4 is in communication with a connecting pipe 5, the outside of the heating head 4 is wrapped with a PTC heating layer, the inner diameter of the heating head 4 is gradually reduced from the end at the connecting pipe to the end at the heating head 4, the front end of the heating head 4 is in communication with a copper sleeve 6, the copper sleeve 6 is provided with an adhesive outlet 7 through which melted adhesive rod flows out, and the center line of the adhesive rod is always aligned with the center line of the heating head 4. As the PTC heating layer is arranged outside the funnel-shaped heating head 4, i.e., the PTC can be seen as an infinite number of closely-fitted concentric circles with different diameters, and the distance from any position on the same concentric circle to the center of the adhesive rod is the same, the heat radiation distance is the same, which makes the heating more uniform and the heating time shorter. In addition, as the distance from any position on the concentric circle with the smallest diameter to the center of the adhesive rod is the smallest, i.e., the heat radiation distance is the smallest, the time required is also the shortest, which can be reduced from the original 2-3 minutes to 15 seconds.

The inner wall of the adhesive gun housing 1 is rotationally connected with a trigger 8, part of the trigger 8 extends to the outside of the adhesive gun housing 1, the trigger 8 is located on the inner side of the adhesive gun housing 1 and is fixedly connected with a first connecting piece 9, and the first connecting piece 9 is hinged with a second connecting piece 10; the inner wall of the adhesive gun is slidably connected with a sliding block 11, the second connecting piece 10 is hinged on the sliding block 11, the sliding block 11 have an opening for the adhesive rod to pass through, and the sliding block 11 is fixedly connected with a sleeve 12 for the adhesive rod to pass through.

A PCB assembly 13 is arranged in the adhesive gun housing 1, the PCB assembly 13 is connected with a light button 14, and an indicator light is arranged on the surface of the adhesive gun housing 1.

A battery jar used for holding dry batteries is formed in the bottom of the adhesive gun housing 1.

The adhesive rod is sheathed with an anti-slide member 15 at the position against the adhesive inlet 2 to prevent the adhesive rod from shifting. In order to prevent the adhesive rod from shifting, the anti-slide member 15 is provided.

The adhesive rod is sheathed with a spring 16 at the position against the joint of the heating cavity and the connecting pipe 15.

The surface of the adhesive gun housing 1 has a plurality of viewing windows 17 used for observing the remaining amount of the adhesive rod, and the number of the viewing windows 17 is two. The viewing windows 17 are used for observing the remaining amount of the adhesive rod in real time, and a new adhesive rod can be added in time when the remaining amount is insufficient.

The surface of the adhesive gun housing 1 has a jack 18 used for charging.

The specific operation steps of the present invention are as follows: the present invention can be powered by dry batteries or rechargeable batteries; when the adhesive gun is used, an adhesive rod is first inserted into the adhesive gun housing 1 along the adhesive inlet 2, and passes through the connecting pipe 5 to the heating head 4 (heating cavity) and the copper sleeve 6 at the same time. Then power is switched on to make the PTC heating layer start to work and transfer heat to surface of the heating head 4, and the heat is transferred to the heating cavity by the heating head 4 to heat and melt the adhesive rod in the heating cavity. As the heating head 4 is set in a funnel shape, the heat radiation distance from the PTC heating layer to the adhesive rod is reduced along the reducing direction of the inner diameter of the funnel, making the heat radiation distance the smallest at the front end of the heating head 4, i.e., at the part of the funnel with the smallest inner diameter; thus the heating time is shorter, and the heating is more uniform; this position is also the nearest position to the copper sleeve 6, and the adhesive rod melted after heating can flow into the copper sleeve 6 immediately. The heating time is reduced from the original 2-3 minutes to 15 seconds, and as the heating cavity has a good thermal conductivity, the adhesive rod in the heating cavity is quickly melted by the heating head 4, and heat is transferred to the copper sleeve 6; the copper sleeve 6 also has a good thermal conductivity, so adhesive can flow out from the adhesive outlet 7 in the copper sleeve 6, and the adhesive outlet 7 in the copper sleeve 6 only need to be aimed at a position that need to be bonded.

When the trigger 8 is pulled by a user, the trigger 8 is rotated together with the first connecting piece 9, and the first connecting piece 9 moves together with the second connecting piece 10, thus the sliding block 11 is driven to move together with the adhesive rod, making the adhesive rod fed into the heating head 4 to be melted again, which is convenient for adhesive to flow out again. Pulling the trigger 8 can make the adhesive rod flow out continuously.

The above shows and describes the basic principle, main features and advantages of the present invention. Those skilled in the art shall understand that the present invention is not limited by the above embodiment. The above embodiment and description merely illustrate the principle of the present invention. Various changes and improvements can also be made to the present invention without departing from the spirit and scope of the present invention, and shall fall into the scope of the present invention. The protection scope of the present invention is defined by the appended claims and equivalents.

The invention claimed is:

1. A fast hot melt adhesive gun, comprising an adhesive gun housing, wherein an end part of one end of the adhesive gun housing is provided with an adhesive inlet, a heating cavity configured for heating an adhesive rod is formed in the adhesive gun housing, an inner wall of the adhesive gun housing is fixedly connected with a chute for the adhesive rod to slide, the heating cavity comprises a funnel-shaped heating head having an exterior with a surface area located at a front end of the hot melt adhesive gun, a rear end of the funnel-shaped heating head is in communication with a connecting pipe, the exterior surface area of the funnel-shaped heating head is covered completely with a PTC heating layer, an inner diameter of the funnel-shaped heating head is gradually reduced from a first end at the connecting pipe to a second end at the funnel-shaped heating head, a copper sleeve having an adhesive outlet extends from the second end of the heating head, wherein a melted adhesive rod flows out through the adhesive outlet, and a center line of the adhesive rod is aligned with a center line of the funnel-shaped heating head.

2. The fast hot melt adhesive gun according to claim 1, wherein the inner wall of the adhesive gun housing is rotationally connected with a trigger, a part of the trigger extends to an outside of the adhesive gun housing, the trigger is located on an inner side of the adhesive gun housing and the trigger is fixedly connected with a first connecting piece, and the first connecting piece is hinged with a second connecting piece; the inner wall of the adhesive gun housing is slidably connected with a sliding block, the second connecting piece is hinged on the sliding block, and the first connecting piece and the second connecting piece have openings for the adhesive rod to pass through.

3. The fast hot melt adhesive gun according to claim 1, wherein a printed circuit board (PCB) assembly is arranged in the adhesive gun housing, the PCB assembly is connected with a light button, and an indicator light is arranged on a surface of the housing.

4. The fast hot melt adhesive gun according to claim 1, wherein a battery jar configured for holding dry batteries is formed in a bottom of the housing.

5. The fast hot melt adhesive gun according to claim 1, wherein the adhesive rod is sheathed with an anti-slide member at a position against the adhesive inlet to prevent the adhesive rod from shifting.

6. The fast hot melt adhesive gun according to claim 1, wherein the adhesive rod is sheathed with a spring at a position against a joint of the heating cavity and the connecting pipe.

7. The fast hot melt adhesive gun according to claim 1, wherein a surface of the housing has a plurality of viewing windows configured for observing a remaining amount of the adhesive rod, and a number of the viewing windows is two.

8. The fast hot melt adhesive gun according to claim 1, wherein a surface of the housing has a jack configured for charging.

* * * * *